United States Patent [19]

Thomas

[11] Patent Number: 4,736,948

[45] Date of Patent: Apr. 12, 1988

[54] FOOTBALL

[76] Inventor: Milton L. Thomas, 210 Curtis Dr., J-3, Atlanta, Ga. 30319

[21] Appl. No.: 37,826

[22] Filed: Apr. 13, 1987

[51] Int. Cl.[4] ..... A63B 41/00

[52] U.S. Cl. ..... 273/65 EF; 273/65 EG

[58] Field of Search ..... 273/65 R, 65 E, 65 EE, 273/65 EF, 428, 424, 425, 55 R

[56] References Cited

U.S. PATENT DOCUMENTS 2,194,674 3/1940 Riddell ..... 273/65 EG 3,884,466 5/1975 MacDonald ..... 273/65 EC

*Primary Examiner*—George J. Marlo

*Attorney, Agent, or Firm*—Jones, Askew & Lunsford

[57] ABSTRACT

A football is disclosed having an oblate spheroid body with a passageway defined along its longitudinal axis. A pair of wind fins are mounted internally of the body so as to protrude into the passageway. In addition, a second embodiment is disclosed having troughs defined in the exterior of the ball. When the football is thrown, the fins and the troughs act to enhance rotation of the ball.

7 Claims, 2 Drawing Sheets

FOOTBALL

TECHNICAL FIELD

The present invention relates to game balls and, more particularly, relates to an aerodynamically modified football.

BACKGROUND OF THE INVENTION

Primarily because of its oblong shape, a football is difficult to pass and catch. In order to pass a football accurately over any meaningful distance, the passer must not only launch the ball into the air, but must also simultaneously impart a rotation to the ball about its longitudinal axis. The tighter this rotation, the greater distance over which the ball may be accurately thrown. In order to catch a football, the receiver must grasp the ball and stop this rotation. Because it is difficult to stop the rotation of the football by grasping either of its pointed ends, the receiver must catch the ball by its central body portion. For these and other reasons, the skills of passing and catching a football have long been recognized as difficult to acquire.

In an effort to assist both the professional and the amateur or recreational football player to develop the skills of passing and catching, modifications have been made to the conventional football. For example, U.S. Pat. No. 2,194,674 to Riddell discloses a football with a plurality of surface ridges. As another example, U.S. Pat. No. 3,884,466 to MacDonald et al. dicloses a football having an air passage extending through its longitudinal axis. The diameter of this air passage decreases from the outer ends thereof to a constricted opening midway of the length of the football. The purpose of such modifications is to enhance the desired rotation of the football and thereby obtain greater distance and accuracy.

However, such prior art attempts to modify a football fail to maximize air flow in order to enhance rotation of the ball. The surface ridges taught by Riddell are of minimal or even negligible effect because the ridges emanate from the ends of the ball. As a result, the ball will displace air well beyond the purview of the ridges. Furthermore, these ridges hamper the receiver learning to catch the ball because they protrude from the surface thereof. Especially for the professional athlete, it is imperative that any football used for training be similar as possible to that used in actual play. While the football shown by MacDonald provides a venturi-like configuration that is said to assist in throwing the ball over greater distances, it fails to utilize the flow of air through the passage along the football's longitudinal axis to enhance rotation of the ball. As noted above, the better the relation of the ball, the more accurately it may be thrown. Thus, the MacDonald modification fails to address this principal concern of one learning to throw a football.

SUMMARY OF THE INVENTION

The present invention solves the above-described problems in the prior art by providing a football that has been modified aerodynamically to best utilize the air flow to enhance the rotation of a football. In addition, a football according to the present invention is similar to that used in actual play so as to provide a true practice ball for both the professional and the amateur player.

Generally described, a first embodiment of the present invention comprises a football having an oblate spherical shape defining a longitudinal axis, a cylindrical passage defined along the longitudinal axis of the football, and a pair of air flow divertors mounted internally of said football so as to protrude into the passage in such a manner as to enhance rotation of the football.

A second embodiment of the present invention comprises a football having an oblate spherical shape defining a longitudinal axis, a plurality of troughs defined in the outer surface of the football, a cylindrical passage defined along a longitudinal axis of the football, and a pair of air flow diverters mounted internally of the football so as to protrude into the passage so that both the troughs and the air flow diverters cooperate to enhance rotation of the football.

Thus, it is an object of the present invention to provide an aerodynamically modified football.

It is a further object of the present invention to maximize utilization of air flow in order to enhance rotation of a football.

It is a further object of the present invention to provide a football having an internal passage that not only provides a venturi-like configuration to increase throwing distance, but further utilizes the flow of air through such configuration to enhance rotation of the ball.

It is a further object of the present invention to provide an aerodynamically modified football to assist professional and amateur athletes in learning to pass and catch a football.

It is a further object of the present invention to provide an aerodynamically modified football that is Other objects, features and advantages of the present invention will become apparent from reading the following specification in conjunction with the accompanying drawings.

DETAILED DESCRIPTION

Figure 1:
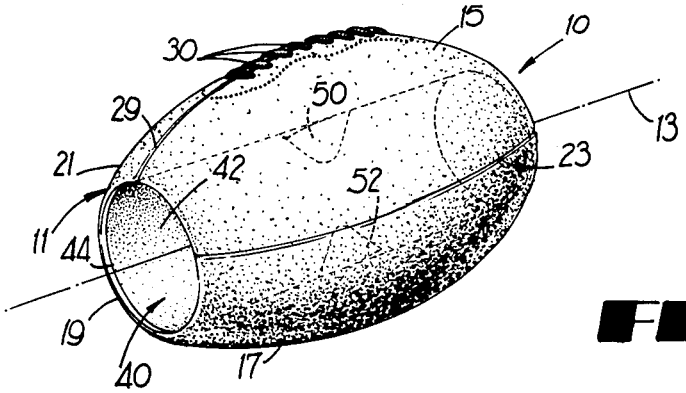
FIG. 1 is a pictorial view of an embodiment of a football according to the present invention showing the internal passageway in phantom to aid in explaining of the present invention.

Referring now in more detail to the drawing, in which like numerals indicate like parts throughout the several views, FIG. 1 shows a first embodiment of a football 10 according to the present invention. As shown, the football 10 consists of an oblate spheroid body 11 that defines and is symmetrical about a longitudinal axis 13. The body 11 is conventionally formed having four leather panels, 15, 17, 19 and 21 stitched together at seams 23, 25, 27 and 29. The leather panels 15, 17, 19 and 21 are secured about an inflatable rubber bladder (not shown). The bladder is easily inflated by a hand pump or the like so as to give the ball the appropriate shape and weight. The use of such a bladder is well known in the art and hence, need not be disclosed further herein. A plurality of leather laces 30 are stitched about seam 29 between panels 15 and 21. Those skilled in the art will recognize the laces 30 are conventionally provided to assist one in passing the football 10.

A cylindrical passageway 40 of constant diameter is provided about the longitudinal axis 13 of the football 10. The passageway 40 is defined by an interior cylindrical wall 42 which may also comprises the internal wall of the inflatable rubber bladder. Alternatively, the wall 42 may be constructed as a separate element apart from the bladder. The outer ends of the cylindrical passageway 40 define two openings 44 and 46, the forward opening being designated 44 and the rearward opening being designated 46. Thus, as shown best in FIG. 3, the present invention provides for the conventional pointed ends of a football to be eliminated. As a result, the present football 10 is somewhat shorter in length than a conventional ball. However, the exterior of the football 10 is otherwise identical to that used in actual play.

Figure 2:
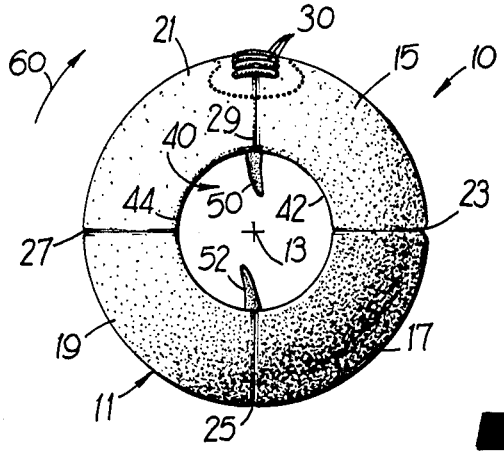
FIG. 2 is a front elevational view of the embodiment shown in FIG. 1.
Figure 3:
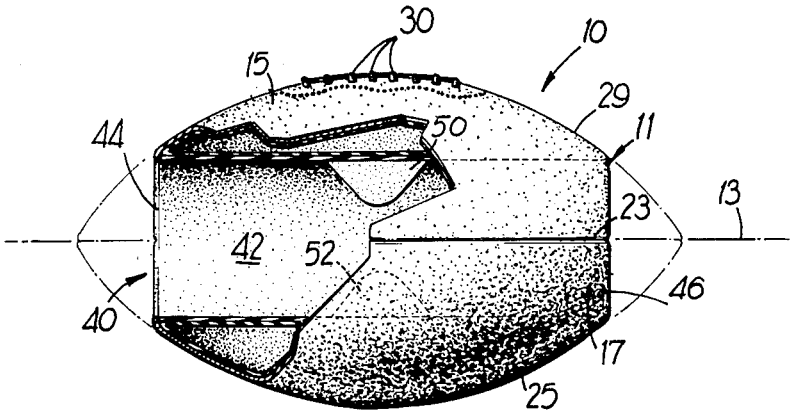
FIG. 3 is a side elevational plan view of the embodiment shown in FIG. 1, with a cut-away portion to aid in demonstrating the construction of this embodiment.

In this first embodiment of the present invention, a pair of wind fins 50 and 52 are provided as shown in FIG. 2. The fins 50 and 52 are substantially triangular in shape and may be formed of any suitably rigid material such as polypropylene, polyethylene or the like. Each fin is secured at its base to the wall 42 of the cylindrical passageway 40 by an adhesive, fastener or other conventional manner. The fins 50 and 52 are located opposite one another at the center of the ball as shown in FIG. 3.

The fins 50 and 52 are provided in a skewed alignment relative to the longitudinal axis of the football 10. As best shown in FIG. 2, the base of the upper fin 50 is aligned so that its forward portion is slightly skewed toward the seam 23. In a similar manner, the lower fin 52 is aligned so that its forward portion is slightly skewed toward the seam 27. In addition, each fin 50 and 52 is configured having a curved contour. The fin 50 is configured so as to curve toward seam 23 as the fin protrudes further into the passageway 40. In a similar manner, the fin 52 is configured so as to curve toward seam 27 as it protrudes into the passageway 40. The effect of the curved portion of each fin 50 and 52 in combination with the skewed alignment thereof is to enhance rotation of the ball 10 when thrown.

It is to be understood that the alignment and curve of the fins 50 and 52 provide a certain rotation of the ball. For example, when the fins 50 and 52 are aligned as shown in FIG. 2, the effect of the fins is to produce a clockwise rotation of the ball 10, indicated by the arrow 60, as viewed by the receiver. Such a rotation would assist a right-handed person in imparting the proper rotation of the ball. If the alignment of the fins 50 and 52 is reversed (not shown), the effect would be to create a counterclockwise rotation of the ball 10 suitable to assist a left-handed person passing it. Thus, the present invention contemplates that different balls may be provided for a right-handed and a left-handed passer and that such balls may be designated according to their intended user.

Figure 4:
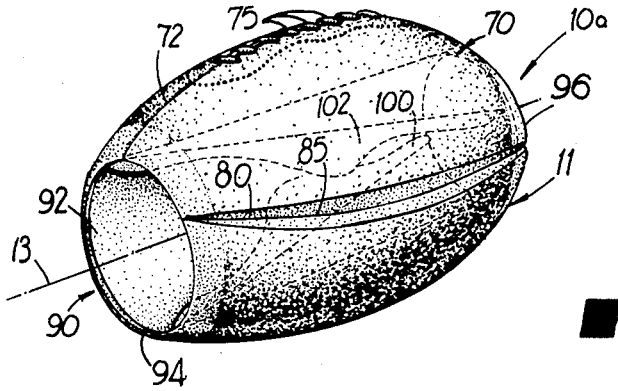
FIG. 4 is a pictorial view of a second embodiment of a football according to the present invention with the internal passageway shown in phantom to aid in explaining the present invention.
Figure 5:
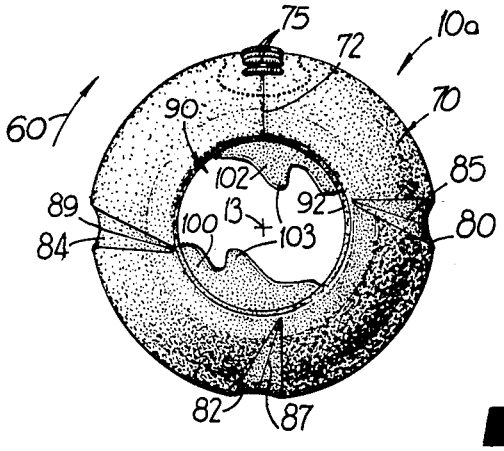
FIG. 5 is a front elevational view of the embodiment shown in FIG. 4.
Figure 6:
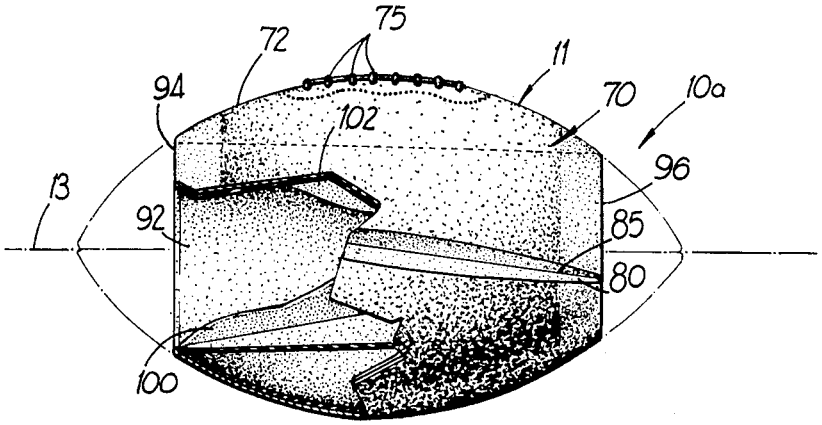
FIG. 6 is a side elevational view of the embodiment shown in FIG. 4, with a cut-away portion to aid in demonstrating the construction of the present invention.

A second embodiment of the present invention is shown in FIGS. 4–6. FIG. 4 shows the second embodiment of the present invention generally at **10*a*. In a manner similar to that of the first embodiment, the football 10*a* provides an oblate spheriod body 11 defining a longitudinal axis 13. The ball 10*a* is formed having an exterior leather outer casing 70 stitched about an inflatable rubber bladder (not shown) at a seam 72. A plurality of leather laces 75 are stitched about the seam 72 to provide a conventional arrangement for throwing the football 10*a*. As an alternative construction, the body 11** may be formed as a hollow member made of any suitable material which is lightweight, pliable and easily molded.

The exterior casing 70 of the ball **10*a* is provided with three troughs 80, 82 and 84. The alignment of each trough 80, 82 and 84 is skewed so as to enhance rotation to the ball. Each trough is formed by providing seams 85, 87 and 89 at the lowest portion of the troughs 80, 82 and 84, respectively. The effect of each trough is to channel air flow therethrough once the ball is thrown. If the ball 10*a* is to be thrown by a right-handed person, the troughs 80, 82 and 84 are to be skewed as shown in FIGS. 4–6, wherein each forward portion of the troughs is skewed in a clockwise manner so as to be radially closer to the seam 72 when viewing the front end of the ball 10*a***.

In keeping with the present invention, a cylindrical passageway 90 is provided through the interior of the football **10*a* about its longitudinal axis 13. The cylindrical passageway 90 is defined by an inner wall 92 that also forms the inner wall of the inflatable rubber bladder. The passageway 40 defines a lead opening 94 and a trailing opening 96. It is to be noted that the passageway 90 is of constant diameter throughout its length. Even so, as illustrated in FIG. 6, this second embodiment of the invention also calls for the ball 10*a*** to be shorter than a conventional football.

A pair of elongated fins 100 and 102 are provided within the passageway 90. As shown best in FIG. 4, each fin 100 and 102 extends the length of the passage 90 and, in a manner similar to that described hereinabove, is skewed away from the longitudinal axis 13 and curved so as to provide a maximum rotating effect. Each fin 100 and 102 is formed having a protruding crest 103 that extends further into the passageway 90 than any other portion thereof. The crests 103 of the elongated fins is positioned at the center of the ball as shown in FIG. 6. The fins 100 and 102 preferably made of a plastic material such as polyethylene or polypropylene or the like and can be secured to the inner wall 92 in a conventional manner.

In order to throw the first embodiment of the football 10, the passer grasps the football in a conventional manner about the leather lacings 30. Assuming that the passer is right-handed, he will impart a clockwise rotation to the ball as it moves away from him. The effect of the skewed alignment and curved configuration of the fins 50 and 52 will be to allow the flow of air passing through the passageway 40 to engage the fins and impart a greater rotation to the ball. In addition, a venturi-like effect will result and cause the ball 10 to travel over a greater distance. Of course, if a left-handed passer were throwing the ball 10, the fins 50 and 52 would be rearranged so as to assist in imparting a counterclockwise rotation to the ball 10. Other than this change, the throwing of the ball 10 is identical to that for a right-handed passer.

In order to throw the second embodiment of the football **10*a*, a passer would once again grasp the ball in a conventional manner about the leather lacings 75. Upon throwing the ball 10*a*, the right-handed passer would once again impart a clockwise rotation to the ball. The effect of the elongated fins 100 and 102 would be to, in a manner similar to that to fins 50 and 52, engage the flow of air passing through the passage 90 and impart further clockwise rotation to the ball. In addition, the troughs 80, 82 and 84, by virtue of their skewed alignment, would also serve to channel the flow of air about the exterior of the ball and further enhance its rotation. Thus, the ball 10***a* will travel a greater distance. Of course, for a left-handed passer, the fins 100 and 102 as well as the troughs 80, 82 and 84, would be skewed accordingly.

Thus, it is seen that a football according to the present invention enjoys significant advantages over prior art modifications. By means of the fins 50 and 52 and the elongate fins 100 and 102, the present invention utilizes the flow of air through the passages 40 and 93, respectively, to further enhance rotation of the ball. In addition, the outer surface of the first embodiment of the present invention is identical to that of an actual football. While the second embodiment provides the troughs 80, 82 and 84 in the exterior surface of the football 10*a*, the troughs do not protrude from that outer surface and thereby do not impede a receiver trying to catch the ball. In addition, the receiver must catch the ball 10 or 10*a* by the body portion 11 since the pointed end portions of a conventional football have been removed.

While this invention has been described in detail with particular reference to the preferred embodiments thereof, it will be understood that variations and modifications can be effected within the spirit and scope of the invention as described hereinbefore and as defined in the appended claims.

What is claimed is:

1. A football comprising:

an oblate spheroid body having a substantially symmetrical shape about a longitudinal axis;

a cylindrical passage defined in said body along said longitudinal axis; and a pair of opposing fins mounted internally of said spheroid so as to protrude into said passage, whereby, upon throwing said football, said fins engage the flow of air through said passage and enhance rotation of the football.

2. The football of claim 1 wherein said fins are positioned at the center of said passage.

3. The football of claim 1 wherein said fins are of a curved configuration so as to enhance rotation of the football.

4. The football of claim 1 wherein the alignment of said fins is skewed relative to said longitudinal axis so as to enhance rotation of said football.

5. The football of claim 4 wherein said fins are skewed between two and three degrees relative to said longitudinal axis of said football.

6. The football of claim 1 wherein each of said fins traverse the length of said passage and are formed having a crest positioned at the center of said passage.

7. The football of claim 1 further comprising a plurality of troughs formed in the outer surface of said spheroid.

* * * * *